US007946700B2

(12) United States Patent
Rufes et al.

(10) Patent No.: US 7,946,700 B2
(45) Date of Patent: May 24, 2011

(54) PRINTER WITH PRINT HEAD PLATEN

(75) Inventors: Ezequiel Jordi Rufes, Sant Feliu de Llobregat (ES); David Claramunt, Sant Esteve Sesrovires (ES); Xavier Gros, Barcelona (ES); Albert Perez, Sant Cugat del Valles (ES); Jesus Garcia, Terrassa (ES); Xavier Alonso, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 725 days.

(21) Appl. No.: 11/932,685

(22) Filed: Oct. 31, 2007

(65) Prior Publication Data

US 2009/0109269 A1 Apr. 30, 2009

(51) Int. Cl.
*B41J 2/01* (2006.01)

(52) U.S. Cl. ..... 347/102; 347/17; 347/104

(58) Field of Classification Search ..... 347/17, 347/102, 104; 400/648, 656, 657; 101/487, 101/488

See application file for complete search history.

(56) References Cited

U.S. PATENT DOCUMENTS

| | | | | |
|---|---|---|---|---|
| 4,946,297 | A | 8/1990 | Koike et al. | |
| 5,000,595 | A | 3/1991 | Koike et al. | |
| 5,717,446 | A * | 2/1998 | Teumer et al. | 347/35 |
| 6,137,510 | A * | 10/2000 | Sato et al. | 347/63 |
| 6,336,722 | B1 * | 1/2002 | Wotton et al. | 347/102 |
| 6,652,091 | B2 * | 11/2003 | Tanno | 347/104 |
| 7,232,269 | B2 * | 6/2007 | Ohyama | 400/642 |
| 7,416,296 | B2 * | 8/2008 | Takeda et al. | 347/104 |
| 7,703,912 | B2 * | 4/2010 | Sootome et al. | 347/104 |
| 2001/0028380 | A1 | 10/2001 | Wotton et al. | |

* cited by examiner

*Primary Examiner* — Daniel Petkovsek

(57) ABSTRACT

A wet ink printer uses a heated printhead. A platen guides and supports the print medium during printing, and has a plurality of raised ribs. In an example, the ribs extend on the base generally along the advance direction of the print media. Each rib comprises a discontinuous series of rib portions, and wherein between each adjacent pair of ribs is provided a spacing to allow deformation of the print medium towards the platen base.

14 Claims, 2 Drawing Sheets

PRINTER WITH PRINT HEAD PLATEN

BACKGROUND OF THE INVENTION

This invention relates to printers and particularly printers having a print head platen for guiding the print medium.

Typically ink-jet printers, or any printers using wet ink, include a printhead, a print zone positioned adjacent the printhead, a feed mechanism for feeding a print medium through the print zone, and a platen positioned adjacent the print zone, the platen guiding and supporting the print medium in the print zone during printing.

During printing, ink is placed on the print medium by dropping or ejecting ink from the printhead, or by any other printing method well known by those skilled in the art. Ink used in wet ink-type printing includes a relatively large amount of water. As the wet ink contacts the print medium, the water in the ink saturates the fibers of the print medium, causing the fibers to expand, which in turn causes the print medium to buckle.

Buckling, also called cockling, of the print medium tends to cause the print medium either to uncontrollably bend downwardly away from the printhead, or to uncontrollably bend upwardly toward the printhead. In either case, a constant pen-to-print medium spacing is not achieved, leading to poor print quality. Additionally, upwardly buckling print medium may contact a pen nozzle in the printhead, leading to ink smearing on the print medium.

Typically, to achieve good print quality, pen-to-print medium spacing of less than 1.5 millimeters (mm), and preferably less than 1.0 mm, is required. However, bending amplitudes of print medium in certain pen/ink combinations can be greater than 3 mm. To reduce this problem of paper buckling, which varies the pen-to-print medium spacing, various platen designs have been proposed.

One approach is to use a flat platen, with the platen supporting the print medium throughout a print zone defined between the printhead and the platen.

Another approach is to use a platen having raised ribs. These raised ribs support the print medium with a small spacing above the main body of the platen. This spacing improves the drying of the deposited ink and reduces friction between the print medium and the platen, thereby improving the drive of the print medium through the device.

It is also known to apply a vacuum pressure to the space between the print medium and the platen base. This can be achieved by providing holes in the platen, and drawing air in through the holes, for example using a fan.

The different features of the platen, such as rib size and spacing, need to be selected depending on the print medium material and the dimensions of the print head, as these factors all influence the friction levels encountered, which in turn dictate the design of the feed mechanism.

BRIEF DESCRIPTION OF THE DRAWINGS

For a better understanding of the invention, embodiments will now be described, purely by way of example, with reference to the accompanying drawings, in which:

FIG. 2 shows an example of platen rib design of the invention; an

DETAILED DESCRIPTION OF THE INVENTION

The invention relates to wet ink printers. A platen guides and supports the print medium during printing, and has a plurality of raised ribs. In an example, the ribs extend on the base generally along the advance direction of the print media, and each rib comprises a discontinuous series of rib portions.

Figure 1:
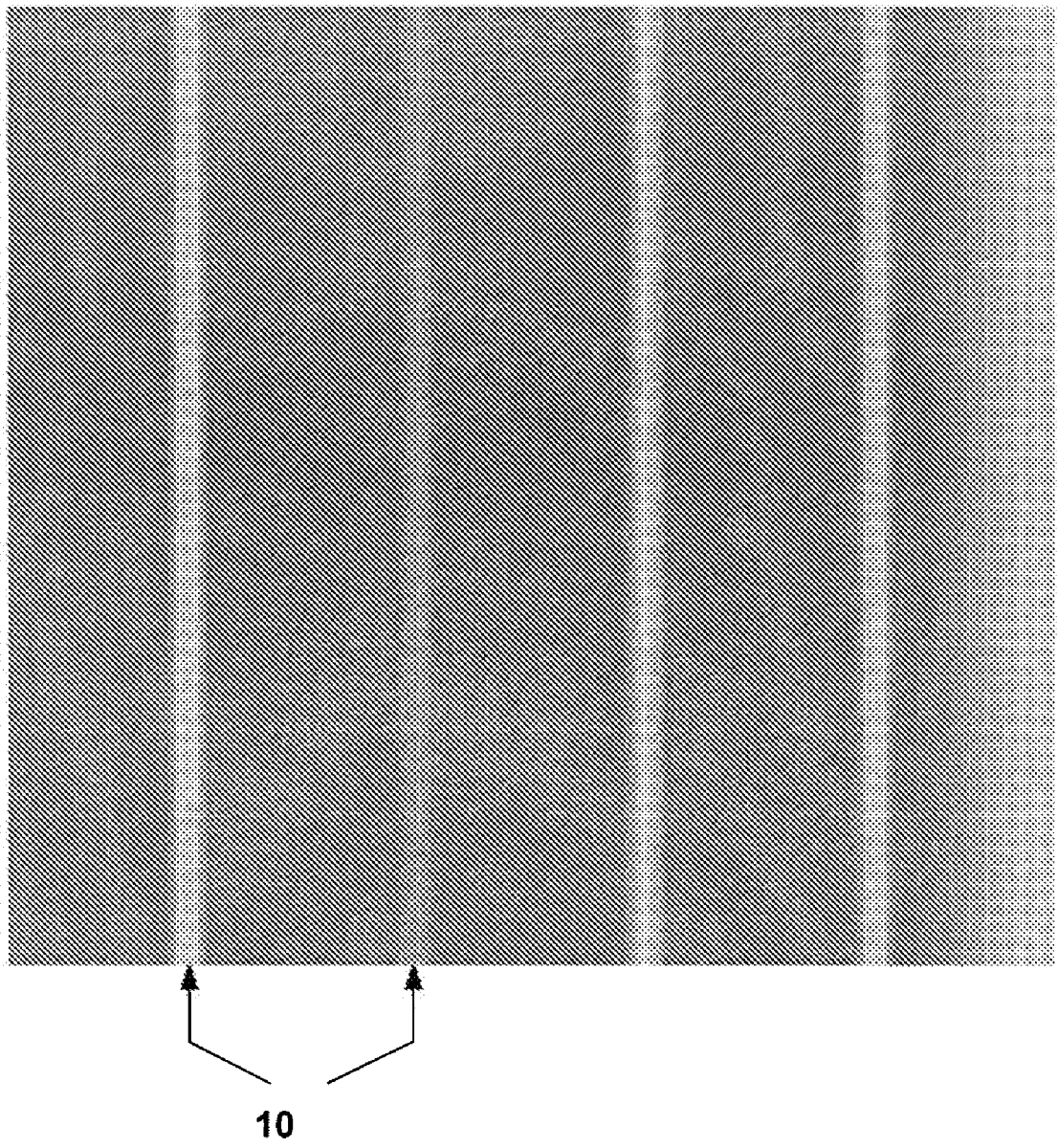
FIG. 1 shows a printing effect which can result from the use of platen ribs aligned with the paper feed direction.

There are a number of problems encountered in print heads. A first problem is illustrated in exaggerated manner in FIG. 1, which shows vertical banding 10.

One aspect of the invention is based on analyzing the effect of heating on the print medium. The heating of the print medium in the region of the print zone causes a thermal expansion. If a platen having continuous vertical ribs (i.e. ribs running in the media advance direction, which is typically the vertical top-to-bottom direction of the printed page) is used, vertical banding can occur.

The ribs run in the print media advance direction so that the friction between the media and the platen is kept low, to ease the design of the drive mechanism.

The banding results from the different thermal conductivity of the ribs and the air filling the spaces between the ribs. This leads to a different temperature at different portions of the media surface. This temperature variation is different for different types of media, but in some cases the variation can be sufficient to change the behaviour of the ink, giving rise to the vertical banding or other unwanted printing marks.

Figure 2:
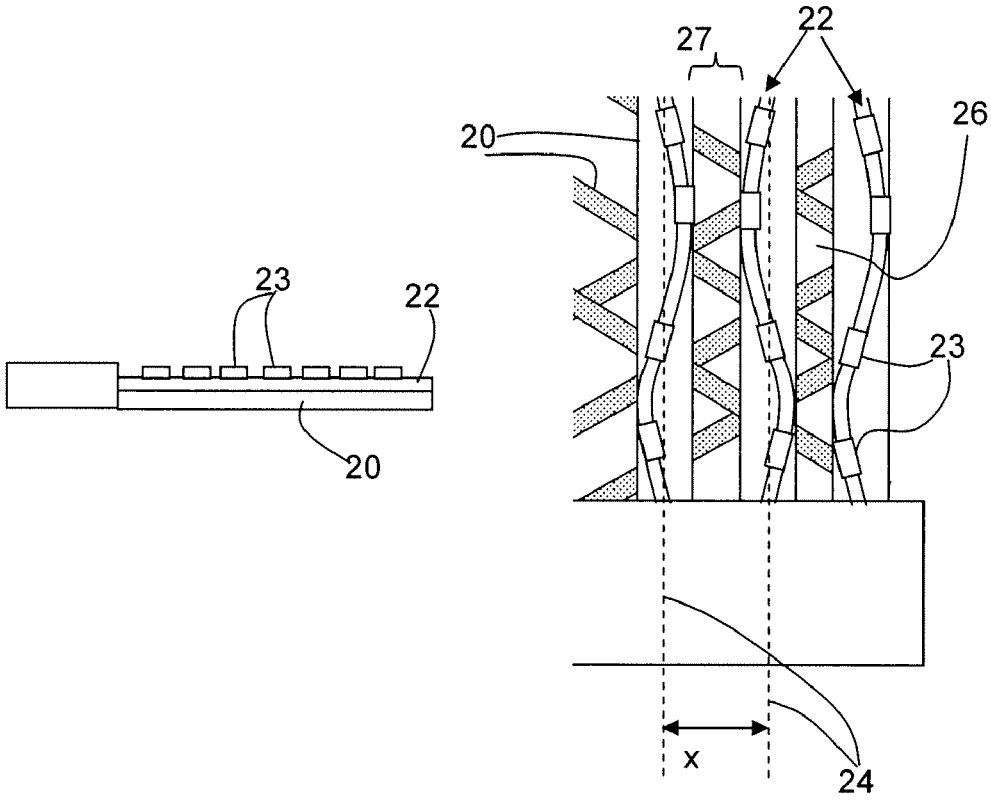

FIG. 2 shows an example of platen.

The platen comprises a base part 20 and a plurality of ribs 22. The ribs run generally in a straight path 24 (which can be considered to be a rib axis), i.e. they extend in the media advance direction. However, they are not perfectly straight, and in the example shown they instead follow a zigzag path.

The zigzag path is shown smooth rather than angular, so that it is effectively a sine wave profile. The rib thus deviates to one side of the straight path 24, then to the other side. The adjacent ribs have a general spacing x between their generally straight axes 24. The zigzagging path extends approximately a distance of 0.2x towards the next axis, although this will be in the range 0.1x to 0.5x.

In one example, the zigzagging path of one rib is out of phase with the next rib. For example, there are two possible phases, with a relative phase difference of 180 degrees. This can be seen in FIG. 2, where one set of alternate ribs can be considered to follow a +sin function, and the other set of alternate ribs can be considered to follow a −sin function. This out-of-phase arrangement is not essential, and the rib shapes can instead be in phase.

The zigzagging reduces the length of a contact surface between the print media and the rib in the media advance direction, so that the contact is distributed discontinuously in the media advance direction. To reduce the contact distance further, the ribs are shown in FIG. 2 as discontinuous, and thus comprise a series of rib portions 23. These rib portions 23 define the highest part of the platen, and act as a discontinuous support surface for the print medium.

FIG. 2 shows the platen from above (on the right) and in cross section (on the left).

The zigzag repeating distance (which in the example of a sine wave function is the wave period) can be made different to the media advance distance. As a print medium is driven past the printhead, printing is carried out across a row, with the printhead scanning across the row direction, with the print medium stationary. The print medium is then advanced for the next row. Different print settings may give different medium advance distances, for example defining overlap between rows or not, as the case may be. If the repeating distance is different to the medium advance distance for any print mode, the points of medium in contact with the platen are different for each print medium advance.

This approach enables the defects in image quality due to thermal flow between the media and the platen to be reduced or eliminated.

In the example shown, the rib portions 23 follow the path of the zigzag. However, they may be aligned with the print medium advance direction but positioned in the zigzag arrangement.

A clear spacing 27 is provided between the ribs 22, and this enables the print medium to deform into a ridged shape across the print medium advance direction. The platen arrangement thus does not aim to remove deformation of the print medium, but instead ensures that the deformation is away from the print head. The spacing 27 will result if straight ribs are used or if the above example of zigzag ribs is used. In the case of zigzag ribs, the maximum deviation of one rib 23 from the centre line 24 must be less than 0.5 times the distance between the centre lines. Thus, even if the ribs are in phase (instead of out of phase as shown in FIG. 2) one rib does not extend into the outer envelope around the next rib.

The print zone is heated to promote drying of the print medium. This is of particular interest for certain types of ink, in particular so-called latex inks. These ideally need to be heated to above 50 degrees Celsius, for example around 55 degrees Celsius, in the print zone, in order to remove water content. It is known for printers using such inks to have a curing zone beyond the print zone, for example approximately 200 mm downstream, and with a higher temperature, such as 90 degrees Celsius. A temperature of around 70 degrees in the curing zone provides melting of the latex balls in the ink.

In one arrangement, a vacuum can be used to hold the print medium against the surface defined by the ribs. Vacuum platens are typically arranged as flat platens, with interconnected surface channels providing the reduced pressure. The use of a vacuum with the rib structure described above ensures that any deformation of the print medium is away from the print head, to prevent contact with the print head, and the amount of deformation that can take place is controlled.

By allowing some deformation of the print medium, the heating can be limited to the print zone, and gradual preheating at an earlier stage can be avoided. Instead, rapid heating only at the print zone can be provided, to encourage rapid phase change and water removal from the print ink.

The design above also provides improvements relating to the friction of the platen. These improvements enable different print media (or different size media) to be driven whilst enabling a low driving force to be used, and still enabling the pen-to-paper distance to be controlled accurately.

It has been found that the combination of platen ribs (for example of the type shown in FIG. 2) with a vacuum system providing a low (weak) vacuum can provide suitable control of much larger print media, for example with print head width up to 20 cm.

The vacuum level can be in the range of 0.2 inches to 1 inch water, or more preferably 0.2 inches to 0.9 inches water, and for example less than 0.8 inches of water. The vacuum level will depend on the print medium. The ribs are less than 1 mm thick (i.e. in the width direction) and are spaced (i.e. dimension x in FIG. 2) by more than 10 mm, for example in the range 20 mm to 30 mm.

This combination of rib dimension and vacuum level enables large print zones to be used, for example up to 15 cm, and more preferably up to 20 cm. The friction is reduced to a level which enables conventional drive mechanisms to be used, even for the larger print medium. The vacuum level is lower than in conventional devices, so that flow requirements are reduced. The system can enable non-standard print media to be supported, such as scrim banners and vinyl.

Figure 3:
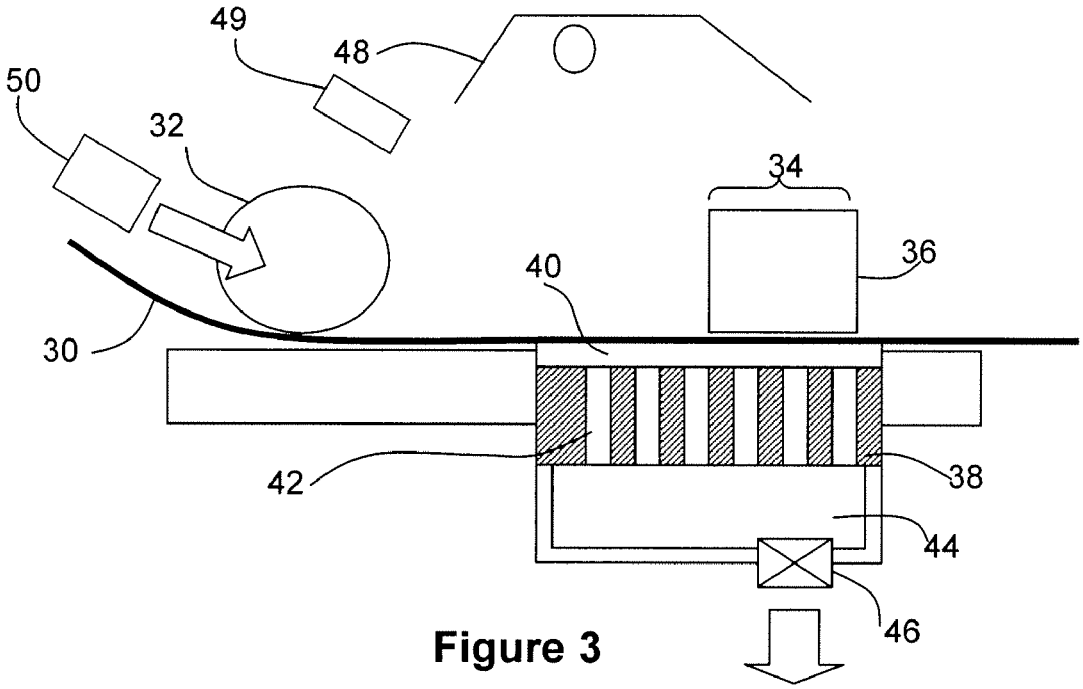
FIG. 3 shows a printer device of an example of the invention.

FIG. 3 shows a portion of a printer forming an example of the invention. The print medium 30 is advanced by a roller arrangement 32 towards the print zone 34, which has a printhead 36.

The platen has a base 38 and upstanding ribs 40, and there are openings 42 through the base to the spaces between the ribs. The platen can be as shown in FIG. 2, for example, and the openings can be seen as 26 in FIG. 2. Beneath the platen base is a vacuum chamber 44. A pump/fan arrangement 46 provides a partial vacuum in the chamber. This provides the required vacuum, but also provides cooling of the platen.

As mentioned above, the print medium is heated to around 55 to 60 degrees Celsius, but the temperature of the platen can be kept below 40 degrees. Thus, the heating of the print medium is in this example by a radiant heat source, rather than by conduction through the platen.

In the example shown, the heat source comprises an infrared lamp 48 above the print medium. The heating can be controlled with a feedback control loop which uses an infrared sensor 49.

Cooling of the print head itself as well as general cooling is provided by a fan/blower arrangement 50. For example a 2 m/s airflow can be provided over the surface of the print medium.

In the example above, an infrared lamp is used as a heating means. However, other types of heat source may be used. For example, although the example above uses radiant heating, a conduction based heater can also be used, for example in thermal contact with the platen. The second stage heating for curing has not be shown, but this can be conventional.

The implementation of the invention will be routine to those skilled in the art. In particular, ribbed platens are generally known, and some examples of the invention simply require modification to the shape, dimensions and spacing of the ribs. The materials used for the platens can also be conventional Similarly, vacuum platens are also known. For example, a chamber can be defined beneath the platen, with a fan drawing air out of the chamber. The chamber is coupled to the space between the platen and the print medium by openings, for example as shown in FIG. 2 as 26. The fan flow rate is selected to provide the required vacuum level. An alternative means for creating a vacuum can be a pump rather than a fan, or indeed any device for moving air.

Similarly, platen heating arrangements are also known. A heater plate can be formed on the underside of the platen, which has a thin foil heater. Other heating arrangements, such as a heater rod or other means can also be used instead of the lamp outlined above. Again, the heating arrangement does not need to be modified from existing heated platen designs.

The platen can be flat or generally slightly curved, depending on the print medium feed arrangement.

The zigzag rib arrangement is only one example, and the discontinuous rib portions can be used with straight ribs to achieve many of the advantages outlined above.

While specific embodiments have been described herein for purposes of illustration, various modifications will be apparent to a person skilled in the art and may be made without departing from the scope of the invention. Accordingly, the invention is not limited to the above-described implementations, but instead is defined by the appended claims in light of their full scope of equivalents.

We claim:

1. A wet ink printer, comprising:

a printhead;

a print zone positioned adjacent the printhead;

a feed mechanism for feeding a print medium through the print zone;

means for heating the print medium in the print zone to dry the printed medium;

a platen positioned adjacent the print zone, the platen guiding and supporting the print medium in the print zone during printing, the platen including a base and a plurality of raised ribs, the ribs extending on the base generally along the advance direction of the print medium, each rib having a discontinuous series of rib portions;

a spacing defined between each adjacent pair of ribs to allow deformation of the print medium towards the platen base; and means for applying a partial vacuum between the print medium and the platen base.

2. A printer as claimed in claim 1, wherein the ribs deviate from a straight path in a zigzag.

3. A printer as claimed in claim 2, wherein the zigzag pattern has a repeating distance, which is different to the media advance distance between printhead actuations.

4. A printer as claimed in claim 3, wherein the zigzag pattern includes at least one period of the zigzag cycle.

5. A printer as claimed in claim 3, wherein the deviation of the zigzag pattern from a central line is less than half of the distance between the central lines of adjacent ribs.

6. A printer as claimed in claim 1, wherein the partial vacuum applied has a pressure of less than 1 inch water.

7. A printer as claimed in claim 1, wherein the ribs are less than 1 mm in width, and laterally spaced by at least 10 mm.

8. A printer as claimed in claim 1, wherein the print head has a printing width of more than 10 cm.

9. A printer as claimed in claim 1, which uses a latex ink.

10. A printer as claimed in claim 1, wherein the means for heating provides an average print zone temperature of more than 50 degrees Celsius.

11. A printer as claimed in claim 1, wherein the means for heating provides a maximum print zone temperature of less than 70 degrees Celsius.

12. A printer as claimed in claim 1, wherein the print head has a printing width of more than 15 cm.

13. A printing method for printing using a wet ink printer, the method comprising:

advancing a print medium over a platen, such that the print medium advances through a print zone, the platen guiding and supporting the print medium on a plurality of raised ribs provided over a base of the platen in the print zone during printing;

applying a partial vacuum between the print medium and the base of the platen;

printing on the print medium in the print zone; and heating the print medium in the print zone to dry the printed medium;

wherein the ribs extend on the base generally along the advance direction of the print medium, wherein each rib comprises a discontinuous series of rib portions, and wherein a spacing is defined between each adjacent pair of ribs to allow deformation of the print medium towards the platen base.

14. A method as claimed in claim 13, wherein the partial vacuum applied has a pressure of less than 1 inch water.

* * * * *